US009976345B2

(12) United States Patent
Chen

(10) Patent No.: US 9,976,345 B2
(45) **Date of Patent: *May 22, 2018**

(54) BLIND BODY BRAKE MECHANISM FOR NON PULL CORD WINDOW BLIND

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/297,855

(22) Filed: Oct. 19, 2016

(65) Prior Publication Data

US 2017/0204656 A1 Jul. 20, 2017

(30) Foreign Application Priority Data

Jan. 14, 2016 (TW) ..... 105101074 A

(51) Int. Cl.
*E06B 9/322* (2006.01)

(52) U.S. Cl.
CPC ..... *E06B 9/322* (2013.01); *E06B 2009/3222* (2013.01)

(58) Field of Classification Search
CPC ..... E06B 9/322; E06B 2009/3222
See application file for complete search history.

(56) References Cited

U.S. PATENT DOCUMENTS

| | | | | |
|---|---|---|---|---|
| 7,025,107 | B2 * | 4/2006 | Ciuca | E06B 9/322 160/170 |
| 9,366,077 | B2 * | 6/2016 | Chen | F16H 31/001 |
| 9,482,049 | B2 * | 11/2016 | Chen | E06B 9/322 |
| 2012/0061502 | A1 * | 3/2012 | Chen | E06B 9/322 242/372 |
| 2014/0083631 | A1 * | 3/2014 | Huang | E06B 9/322 160/170 |
| 2015/0211605 | A1 * | 7/2015 | Yen | B60J 1/2033 475/331 |
| 2016/0123447 | A1 * | 5/2016 | Chen | F16H 31/001 160/168.1 P |
| 2016/0230453 | A1 * | 8/2016 | Chen | E06B 9/322 |
| 2016/0230454 | A1 * | 8/2016 | Chen | E06B 9/322 |
| 2016/0265272 | A1 * | 9/2016 | Chen | E06B 9/322 |
| 2016/0298385 | A1 * | 10/2016 | Chen | E06B 9/324 |
| 2017/0204656 | A1 * | 7/2017 | Chen | E06B 9/322 |

* cited by examiner

*Primary Examiner* — Blair M Johnson
(74) *Attorney, Agent, or Firm* — Muncy, Geissler, Olds & Lowe, P.C.

(57) ABSTRACT

A blind body brake mechanism for non pull cord window blind utilizes two one-way clutch units to control the positioning of the blind body during the extending or receiving operation. Each one-way clutch unit includes a wheel axle, multiple stop blocks equiangularly connected to the wheel axle, an arched rolling groove defined between each two adjacent stop blocks, a planetary gear movably mounted in each arched rolling groove, and a one-way wheel mounted on the wheel axle and having an internal gear meshed with the planetary gears.

6 Claims, 7 Drawing Sheets

BLIND BODY BRAKE MECHANISM FOR NON PULL CORD WINDOW BLIND

BACKGROUND OF THE INVENTION

1. Field of the Invention

The present invention relates to non pull cord window blind technology, and more particularly to a blind body brake mechanism for large size non pull cord window blinds.

2. Description of the Related Art

Conventional window blinds can be classified into pull-cord window blinds and non pull cord window blinds. The pull-cord window blind uses a pull cord for pulling to move the blind between an extended status and a received status. The non pull cord window blind allows a user to pull down or lift the bottom rail, enabling the blind body to be extended out or received subject to the control of a control mechanism.

Although conventional non pull cord window blinds allow easy adjustment between the extended position and the received position. they are lack in a positive positioning design in structure, leading to a rebounding problem when the blind body is fully extended out or a dropping problem when the blind body is fully received. These problems trouble the user in actual operation.

SUMMARY OF THE INVENTION

The present invention has been accomplished under the circumstances in view. It is the main object of the present to provide a blind body brake mechanism for non pull cord window blind, which has the advantages of simple structure, good positioning and ease of operation.

To achieve this and other objects of the present invention, a blind body brake mechanism for a non pull cord window blind is provided to comprise a casing, a rolling-up unit, two transmission units, and two one-way clutch units. The rolling-up unit comprises two meshed upper coil spring winding wheels, two meshed lower coil spring winding wheels, an upper coil spring and a lower coil spring. The two upper coil spring winding wheels are engaged to each other, and the two lower coil spring winding wheels are engaged to each other. The upper coil spring winding wheels and the lower coil spring winding wheels are rotatably mounted in the casing at different elevations and respectively coaxially connected together, so that the upper coil spring winding wheels and the lower coil spring winding wheels can rotate synchronously. The upper coil spring is connected to the two upper coil spring winding wheels and capable of wound around one of the upper coil spring winding wheels. The lower coil spring are connected to the two lower coil spring winding wheels and capable of being wound around one of the lower coil spring winding wheels. Each transmission unit comprises a cord-transfer gearwheel and one lift cord. The cord-transfer gearwheel is rotatably mounted in the casing and meshed with one respective lower coil spring winding wheel, so that the cord-transfer gear wheel can synchronously rotate with the coil spring winding wheel which is engaged with the cord-transfer gear wheel, so that the lift cord will drive the cord-transfer gear wheel rotating when the blind body is extended out, and the lift cord will wind around the cord-transfer gear wheel when the blind body is received. The two one-way clutch units are respectively disposed adjacent to one respective cord-transfer gearwheel. Each one-way clutch unit comprises a wheel axle, at least two stop blocks, a one-way wheel and at least two planetary gears. The wheel axle is fixedly mounted in the casing. The stop blocks are spacedly and fixedly mounted in the casing and connected to a periphery of the wheel axle in such a manner that a rolling groove is defined between each two adjacent stop blocks. The one-way wheel is rotatably sleeved onto the wheel axle and wound round by one of the lift cords, so that the one-way wheel can be driven to rotate by the lift cord which is wound round by the one-way wheel. The one-way wheel comprises an internal gear. The internal gear surrounds the at least two stop blocks. Each planetary gear is rotatably mounted in one respective rolling groove and meshed with the internal gear of the one-way wheel so that each planetary gear is movable in one respective rolling groove by the internal gear of the one-way wheel in one of two reversed directions into engagement with or away from one stop block.

Thus, when the planetary gears are respectively engaged with the stop blocks, the one-way wheel is stopped from rotation, and the blind body is firmly secured in position. When the planetary gears are respectively disengaged from the stop blocks, the one-way wheel is freely rotatable, allowing the blind body to be extended out or received.

Other advantages and features of the present invention will be fully understood by reference to the following specification in conjunction with the accompanying drawings, in which like reference signs denote like components of structure.

DETAILED DESCRIPTION OF THE INVENTION

Figure 1:
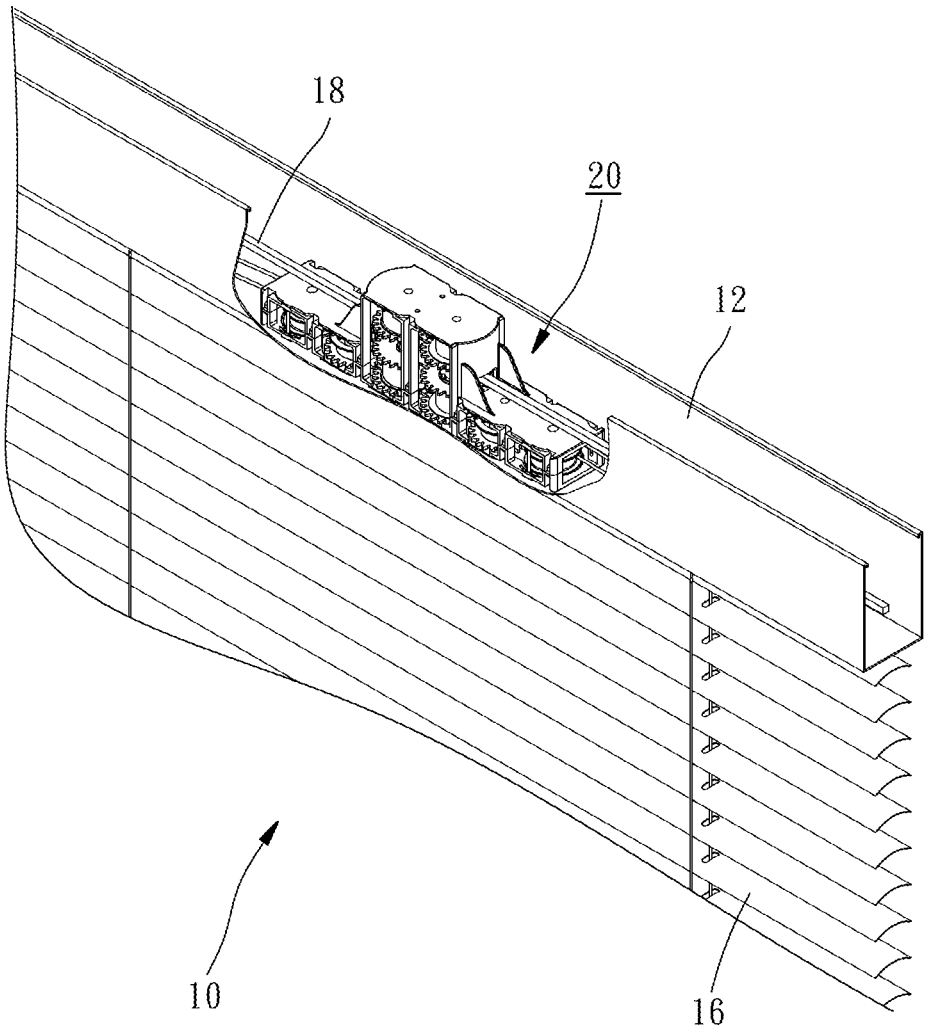
FIG. 1 is a partial perspective view of a window blind in accordance with the present invention.
Figure 2:
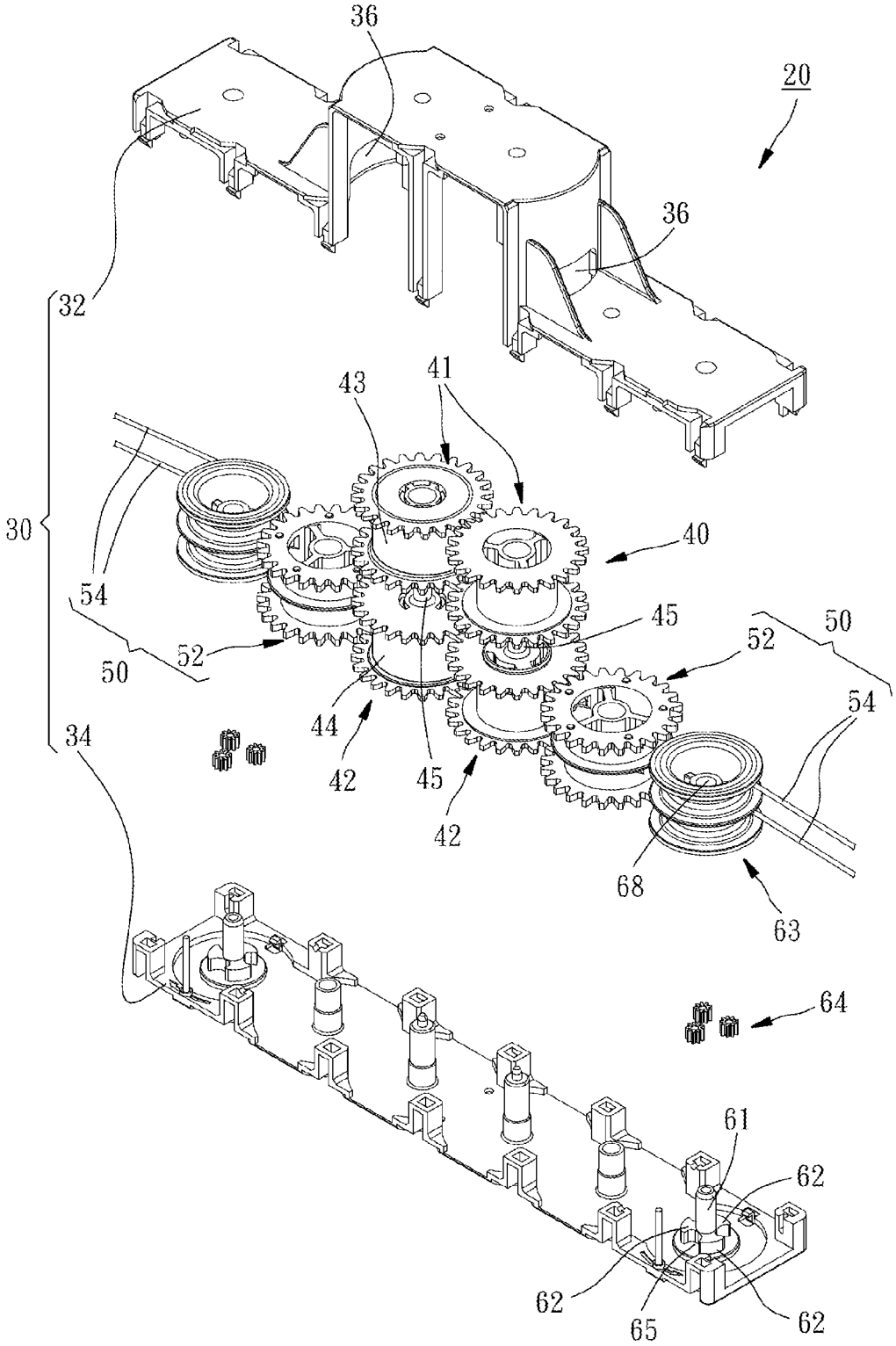
FIG. 2 is an exploded view of the blind body brake mechanism in accordance with the present invention.
Figure 6:
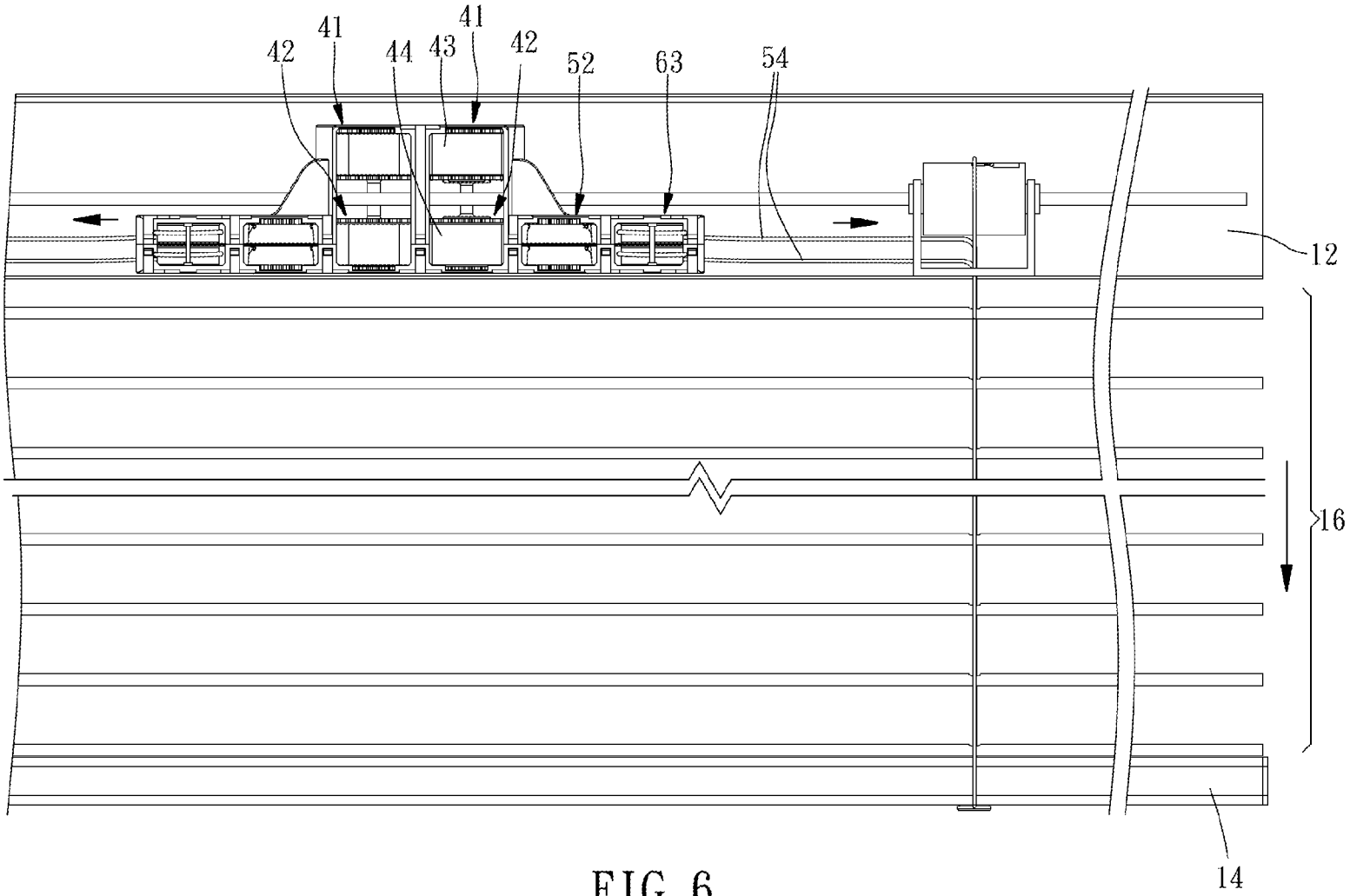
FIG. 6 is a schematic front view of the window blind of the present invention, illustrating an extending status of the blind body.

Referring to FIG. 1 and FIG. 6, a blind body brake mechanism 20 is used in a non pull cord window blind 10 in accordance with the present invention. As illustrated, the non pull cord window blind 10 comprises a top rail 12, a bottom rail 14, and a blind body 16 coupled between the top rail 12 and the bottom rail 14. Further referring to FIG. 2 and FIG. 3, the blind body brake mechanism 20 of the present invention comprises a casing 30, a rolling-up unit 40, two transmission units 50, and two one-way clutch units 60.

The casing 30 is mounted in the top rail 12, comprising a top panel 32 and an opposing bottom panel 34 fastened to the top panel 32. The top panel 32 has two through holes 36 facing each other for the mounting of a steering rod 18 of the non pull cord window blind 10.

The rolling-up unit 40 comprises two upper coil spring winding wheels 41, two lower coil spring winding wheels 42, an upper coil spring 43, a lower coil spring 44, and two connecting shafts 45. The two upper coil spring winding wheels 41 are juxtaposed on the top panel 32 of the casing 30 and meshed with each other. The two lower coil spring winding wheels 42 are juxtaposed on the bottom panel 34 of the casing 30 and meshed with each other. The two connecting shafts 45 are respectively and axially connected to the upper coil spring winding wheels 41 and the lower coil spring winding wheels 42 for enabling them to be rotated synchronously. The upper coil spring 43 has two opposite ends thereof respectively connected to the two upper coil spring winding wheels 41 so that the upper coil spring 43 can be wound around one of the two upper coil spring winding wheels 41 when the two upper coil spring winding wheels 41 are rotated relative to each other. The lower coil spring 44 has two opposite ends thereof respectively connected to the two lower coil spring winding wheels 41 so that the lower coil spring 43 can be wound around one of the two lower coil spring winding wheels 41 when the two lower coil spring winding wheels 41 are rotated relative to each other.

Each of the transmission units 50 comprises a cord-transfer gearwheel 52 and two lift cords 54. The cord-transfer gearwheel 52 is rotatably mounted between the top panel 32 and the bottom panel 34 of the casing 30 and meshed with one of the lower coil spring winding wheels 42 for synchronous rotation. Each of the lift cords 54 has two opposite ends thereof respective fixedly connected to the bottom rail 14 and one respective cord-transfer gearwheel 52. Thus, the two lift cords 54 either can be taken up by the associating cord-transfer gearwheels 52 and wound around the associating cord-transfer gearwheels 52 in a vertical juxtaposition manner (see FIG. 7) to lift the bottom rail 14, or let off from the associating cord-transfer gearwheels 52 to cause rotation of the associating cord-transfer gearwheels 52 in the revered direction as the bottom rail 14 is being pulled downwards by an external force.

The one-way clutch units 60 are respectively disposed adjacent to the respective cord-transfer gearwheels 52, each comprising a wheel axle 61, three stop blocks 62, a one-way wheel 63, and three planetary gears 64.

The wheel axle 61 has two opposite ends thereof respectively fixedly fastened to the top panel 32 and the bottom panel 34 of the casing 30.

Figure 4:
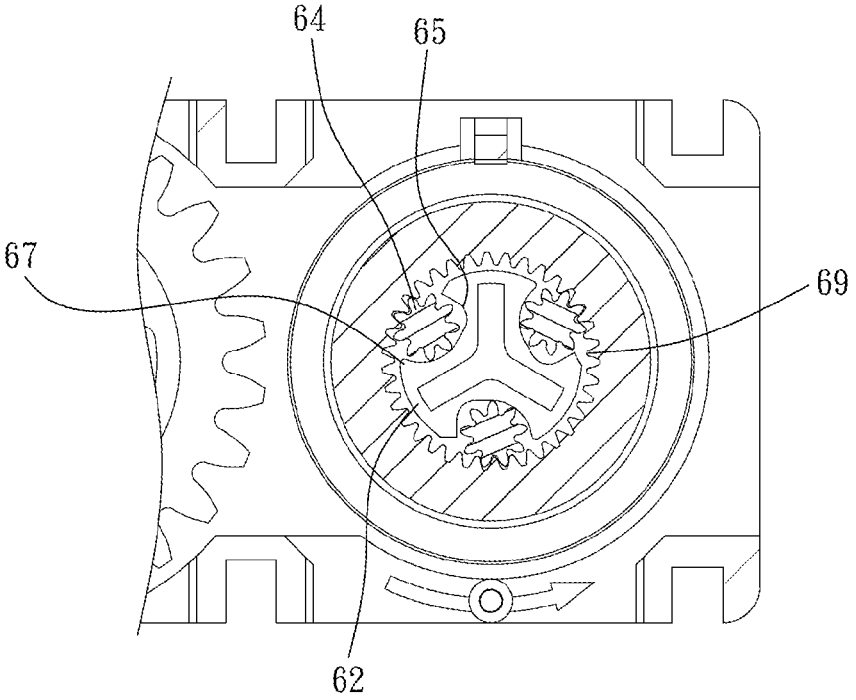
FIG. 4 is a sectional view of a part of the one-way clutch unit, illustrating the planetary gears engaged with the brake portions in the respective arched sliding grooves.
Figure 5:
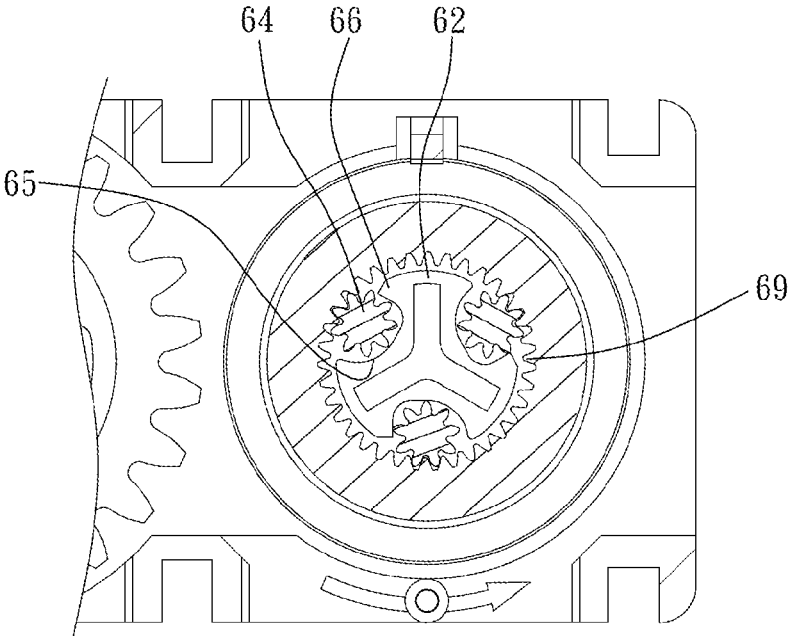
FIG. 5 is similar to FIG. 4, illustrating the planetary gears engaged with the receiving portions of the stop block.

The stop blocks 62 are equiangularly mounted on the bottom panel 34 of the casing 30 around a periphery of the wheel axle 61 so that an arched rolling groove 65 is defined between each two adjacent stop blocks 62. As illustrated in FIGS. 4 and 5, the curvature of one end of each arched rolling groove 65 is larger than the curvature of an opposite end thereof. Two ends of each stop blocks 62 are adjacent to different stop blocks 62 respectively. A brake portion 66 and a receiving portion 67 are respectively formed at the two opposite ends of each arched rolling groove 65 of the stop blocks 62 due to the curvature difference between the two opposite ends of each arched rolling groove 65. As illustrated in FIGS. 4 and 5, the curvature of the brake portion 66 is larger than the curvature of the receiving portion 67.

Figure 3:
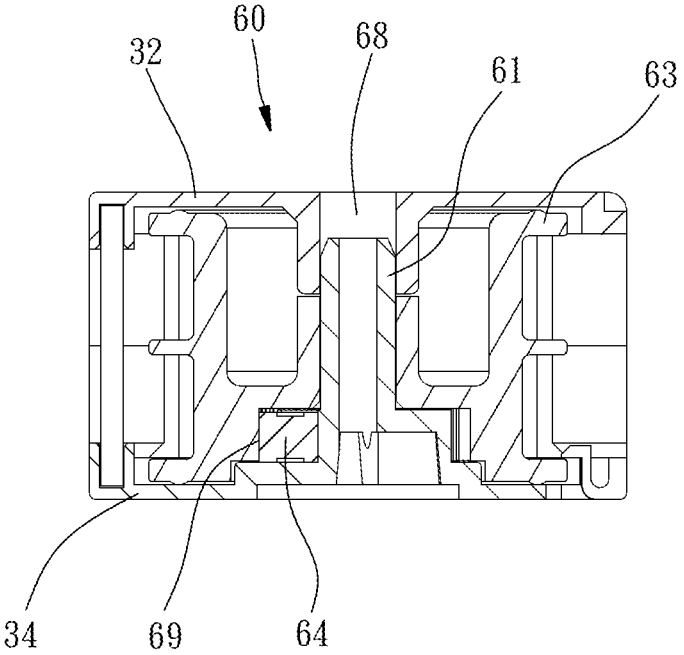
FIG. 3 is a sectional view of one one-way clutch unit of the blind body brake mechanism in accordance with the present invention.

The one one-way wheel 63 comprises a center axle hole 68 and an internal gear 69 adjacent to the center axle hole 68. As shown in FIGS. 3 and 4, by means of the center axle hole 68, each of the one one-way wheels 63 is sleeved onto the associating wheel axle 61 to keep the internal gear 69 surround the associating stop blocks 62. Further, the two lift cords 54 of each transmission unit 50 are wound around the one-way wheels 63 through one turn in a manner that the two lift cords 54 are vertically juxtaposed so that when the two lift cords 54 are driven downward by the bottom rail 14, the one-way wheel 63 of the respective one-way clutch unit 60 is forced to rotate synchronously.

The planetary gears 64 are respectively mounted in the arched rolling grooves 65 and meshed with the internal gear 69 of the associating one-way wheel 63 so that the planetary gears 64 are capable of being driven by the internal gear 69 to move along the respective arched rolling grooves 65 during rotation of the one-way wheel 63.

Thus, when a user wants to extend out the blind body 18, as shown in FIG. 6, pull the bottom rail 14 downward to drag the lift cords 54. Under the situation that the lift cords 54 are being dragged by the bottom rail 14, the one-way wheels 63 and the cord-transfer gearwheels 52 are driven to rotate by the lift cords 54. Further, as shown in FIG. 4, the internal gears 69 of the one-way wheels 63 drive the respective planetary gears 64 to move along the respective arched rolling grooves 65 to the respective receiving portions 67 at the respective stop blocks 62. At this time, the planetary gears 64 run idle, enabling the one-way wheels 63 to be pulled to rotate freely by the lift cords 54. On the other hand, during rotation of the cord-transfer gearwheels 52, the respective lower coil spring winding wheels 42 are rotated by the cord-transfer gearwheels 52, causing the respectively connected upper coil spring winding wheels 41 to rotate. Thus, the upper coil spring 40 is rolled up from the upper coil spring winding wheel 41 on the left side in FIG. 6 by the upper coil spring winding wheel 41 on the right side in FIG. 6 to preserve elastic restoring energy, and at the same time, the lower coil spring 44 is rolled up from the lower coil spring winding wheel 42 on the left side in FIG. 6 by the lower coil spring winding wheel 42 on the right side in FIG. 6 to preserve elastic restoring energy.

When the blind body 16 reaches the appropriate extended position, release the pressure from the bottom rail 14, the upper coil spring winding wheel 41 and the lower coil spring winding wheels 42 will be driven to rotate slightly and inversely by the elastic restoring force which is exerted by the upper coil springs 43 and the lower coil springs 44 and transmitted to the cord-transfer gearwheels 52 via the lower coil spring winding wheels 42. After that, a small part of the lift cords 54 are rolled up by the one-way wheels 63 when the cord-transfer gearwheels 52 rotates reversely, and further, the planetary gears 64 are driven by the respective internal gears 69 of the one-way wheels 63 to move along the respective arched rolling grooves 65 into engagement with the respective brake portions 66 at the respective stop blocks 62, as shown in FIG. 5. The planetary gears 64 are then stopped from rotation. When the planetary gears 64 are stopped, the one-way wheels 63 are stopped too, at this time, by means of friction between the lift cords 54 and the one-way wheels 63, the lift cords 54 are kept in static balance with the elastic restoring force of the upper and lower coil springs 43,44, holding the blind body 16 positively in the extended status.

Figure 7:
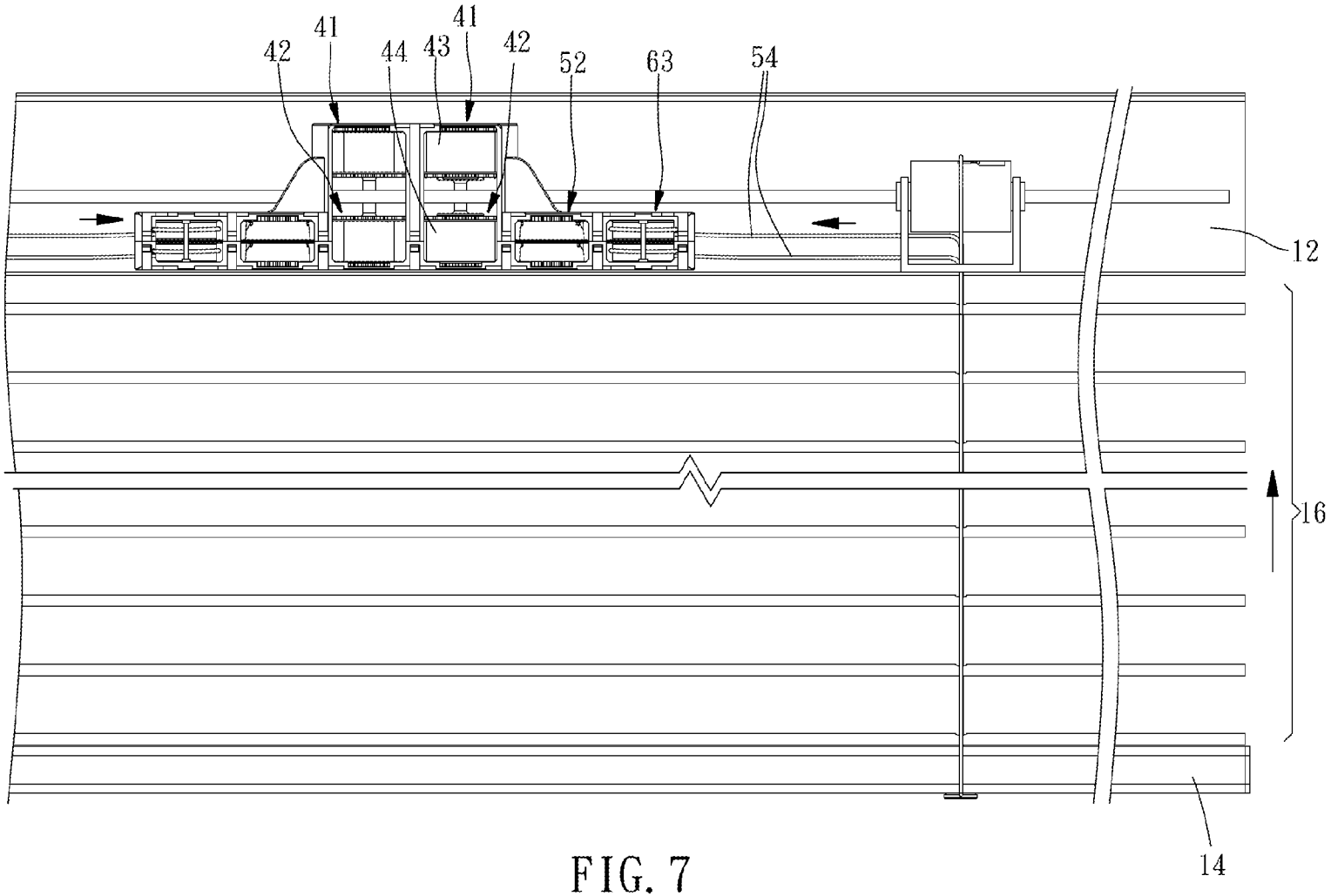
FIG. 7 is similar to FIG. 6, illustrating a receiving process of the blind body.
Figure 8:
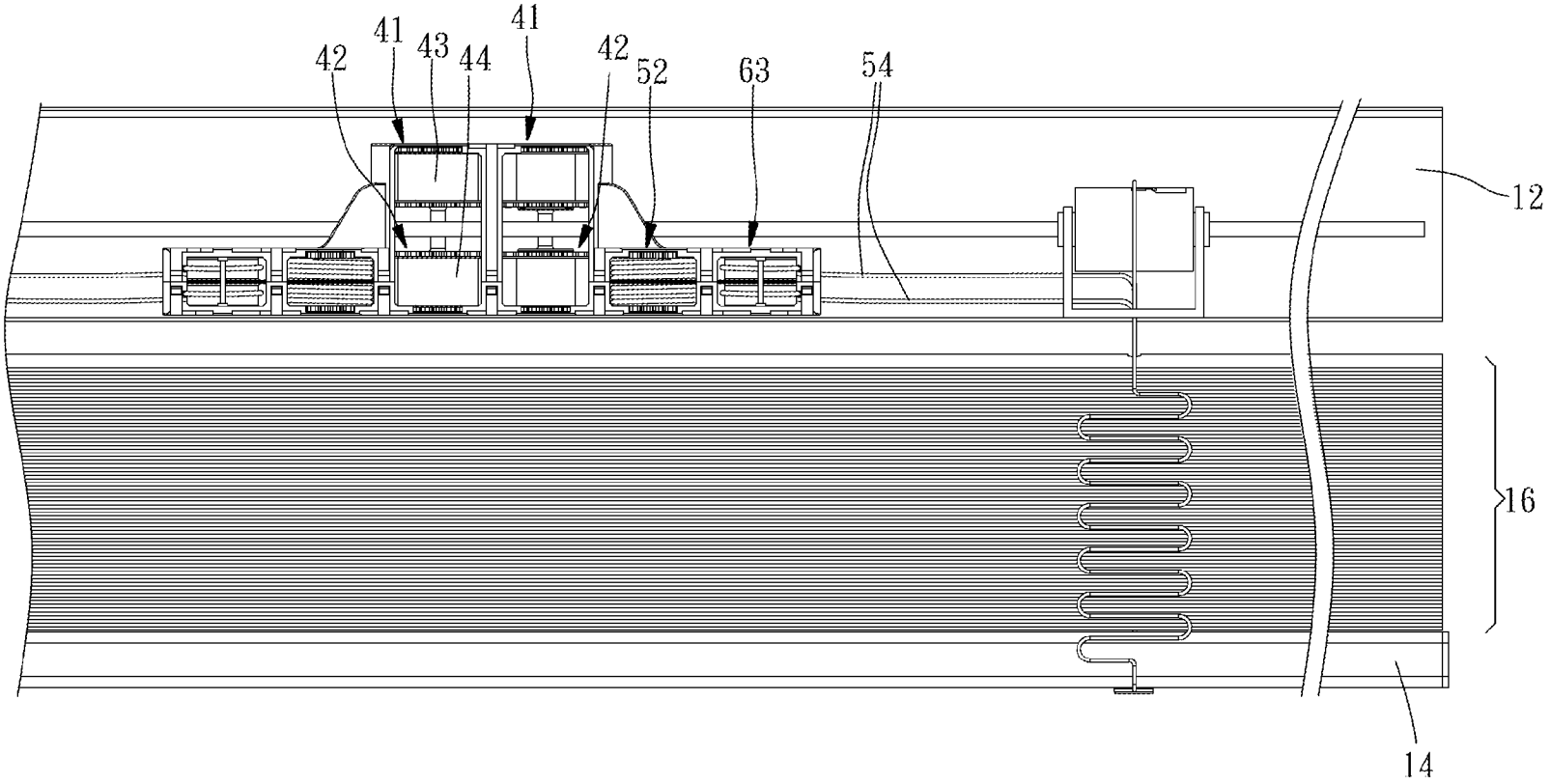
FIG. 8 is similar to FIG. 7, illustrating the blind body in the received status.

When the user wants to receive the blind body 16, as shown in FIG. 7, apply a force to lift the bottom rail 14 and to lose the lift cords 54, reducing the friction resistance between the one-way wheels 63 and lift cords 54, thus, subject to the effect of the elastic restoring force of the upper and lower coil springs 43,44 and the upward push force of the user, the upper and lower coil spring winding wheels 41,42 are rotated in the reversed direction synchronously. During reverse rotation of the lower coil spring winding wheels 42, the cord-transfer gearwheels 52 are rotated by the lower coil spring winding wheels 42 to roll up the lift cords 54. As soon as the blind body 16 is completely received, the user can then release the push force from the bottom rail 14, enabling the lift cords 54 to be wound around the respective one-way wheels 63 firmly again. At this time, the blind body 16 is positively positioned in the received status, as shown in FIG. 8. During the process of receiving the blind body 16, the one-way wheels 63 of the one-way clutch units 60 are kept irrotational.

In conclusion, the blind body brake mechanism 20 utilizes the one-way clutch units 60 to achieve positive positioning of the blind body 16. The overall structural arrangement of the present invention is quite simple and can effectively eliminate the problem of rebounding when the blind body is fully extended out and the problem of dropping when the blind body is fully received as seen in the prior art designs, facilitating operation and assuring a high level of operating stability. More particularly, the blind body brake mechanism 20 of the invention is practical for use in a large size non pull cord window blind 10.

What is claimed is:

1. A blind body brake mechanism used in a non pull cord window blind, comprising:

a casing;

a rolling-up unit comprising two meshed upper coil spring winding wheels, two meshed lower coil spring winding wheels, an upper coil spring and a lower coil spring, said upper coil spring winding wheels and said lower coil spring winding wheels being rotatably mounted in said casing at different elevations and respectively coaxially connected together, said upper coil spring being connected to said two upper coil spring winding wheels and capable of being wound around one of said upper coil spring winding wheels, said lower coil spring being connected to said two lower coil spring winding wheels and capable of being wound around one of said lower coil spring winding wheels;

two transmission units, each said transmission unit comprising a cord-transfer gearwheel and at least one lift cord, said cord-transfer gearwheel being rotatably mounted in said casing and meshed with one respective said lower coil spring winding wheel, each said lift cord having one end thereof fixedly connected to one respective said cord-transfer gearwheel; and two one-way clutch units respectively disposed adjacent to one respective said cord-transfer gearwheel, each said one-way clutch unit comprising a wheel axle, at least two stop blocks, a one-way wheel and at least two planetary gears, said wheel axle being fixedly mounted in said casing, said two stop blocks being spacedly mounted in said casing and connected to a periphery of said wheel axle in such a manner that a rolling groove is defined between each two adjacent said stop blocks, said one-way wheel being rotatably sleeved onto said wheel axle and wound round by at least one of said lift cord, said one-way wheel comprising an internal gear, said internal gear surrounding said at least two stop blocks, each said planetary gear being rotatably mounted in one respective said rolling groove and meshed with said internal gear of said one-way wheel so that each said planetary gear is movable in one respective said rolling groove by said internal gear of said one-way wheel in one of two reversed directions into engagement with or away from one said stop block.

2. The blind body brake mechanism as claimed in claim 1, wherein each of said rolling grooves exhibits an arched shape.

3. The blind body brake mechanism as claimed in claim 2, wherein each of said arched rolling grooves has two opposite ends thereof configured to provide different curvatures so that a brake portion and a receiving portion are formed in two opposite ends of each said arched rolling groove at two sides of each said stop block; the curvature of said brake portion is larger than the curvature of said receiving portion; said one-way wheels are prohibited from rotation when said planetary gears are engaged to the respective said brake portions of the respective said arched rolling grooves; said one-way wheels are freely rotatable when said planetary gears are engaged to the respective said receiving portions of the respective said arched rolling grooves.

4. The blind body brake mechanism as claimed in claim 3, wherein the number of said stop blocks is three, and said three stop blocks are equiangularly spaced around the respective said wheel axle so that one of said arched rolling groove is defined between two of said stop blocks that are adjacent to each other.

5. The blind body brake mechanism as claimed in claim 1, wherein said casing comprises two through holes facing toward each other for the insertion of a steering rod.

6. The blind body brake mechanism as claimed in claim 1, wherein the number of said at least one lift-cord of each said transmission unit is two, and said two lift cords are wound around one respective said cord-transfer gearwheel.

* * * * *